United States Patent [19]

Hintikka

[11] 4,368,117

[45] Jan. 11, 1983

[54] PROCESS FOR THE SELECTIVE FROTH-FLOTATION OF SULFIDIC, OXIDIC AND SALT-TYPE MINERALS

[75] Inventor: Väinö V. H. Hintikka, Vanha Ulvila, Finland

[73] Assignee: Outokumpu Oy, Helsinki, Finland

[21] Appl. No.: 235,610

[22] Filed: Feb. 18, 1981

Related U.S. Application Data

[63] Continuation of Ser. No. 49,908, Jun. 19, 1979, abandoned.

[30] Foreign Application Priority Data

Jun. 22, 1978 [FI] Finland ..... 781017

[51] Int. Cl.[3] ..... B03D 1/14

[52] U.S. Cl. ..... 209/167; 209/4

[58] Field of Search ..... 209/166, 167

[56] References Cited

U.S. PATENT DOCUMENTS

| | | | |
|---|---|---|---|
| 2,130,574 | 9/1938 | Breerwood | 209/167 |
| 2,471,384 | 5/1949 | Booth | 209/167 |
| 2,611,485 | 9/1952 | Treher | 209/166 |
| 2,696,912 | 12/1954 | Atwood | 209/166 |
| 2,740,522 | 4/1956 | Almond | 209/166 |
| 2,741,364 | 4/1956 | Wilson | 209/166 X |
| 2,950,818 | 8/1960 | Mueller | 209/166 |
| 3,179,250 | 4/1965 | Buza | 209/166 |
| 3,403,783 | 10/1968 | Andery | 209/167 |
| 3,595,390 | 7/1971 | Booth | 209/166 |
| 3,623,005 | 11/1971 | Perri | 209/166 |
| 3,640,382 | 2/1972 | Jepsen | 209/166 X |
| 3,735,931 | 5/1973 | Weston | 209/166 X |
| 3,799,380 | 12/1973 | Bishop | 209/166 |
| 3,844,412 | 10/1974 | Dominique | 209/166 |
| 3,901,450 | 8/1975 | Weston | 209/5 X |
| 3,912,623 | 10/1975 | Buza | 209/167 |
| 4,090,972 | 9/1976 | Wang | 209/166 |
| 4,274,951 | 6/1981 | Goold | 209/167 |

FOREIGN PATENT DOCUMENTS

| | | | |
|---|---|---|---|
| 47200 | 10/1971 | Australia | 209/167 |
| 1456392 | 11/1976 | United Kingdom | 209/167 |

OTHER PUBLICATIONS

Bailey, Ind'l. Oil & Fat Prods., Interscience Publishers, Inc., 1945, pp. 434, 435.

*Primary Examiner*—Norman Yudkoff

*Attorney, Agent, or Firm*—Brooks, Haidt, Haffner & Delahunty

[57] ABSTRACT

A process for the selective froth-flotation of sulfidic, oxidic and salt-type minerals, whereby an ore is first wet ground to the flotation fineness to obtain a slurry and then the obtained slurry is prepared and froth-flotated. In addition to the collector agent a polysaccharide, lignosulfonate, quargum and/or a surface active additional chemical is used which prevents the collector agent from adhering to the silicate surfaces and passivates active silicate mineral surfaces, or weakens the hydrophobia of minerals to which the collector agent has already adhered. The collector agent and the additional chemical may be added as early as the wet-grinding stage.

5 Claims, 1 Drawing Figure

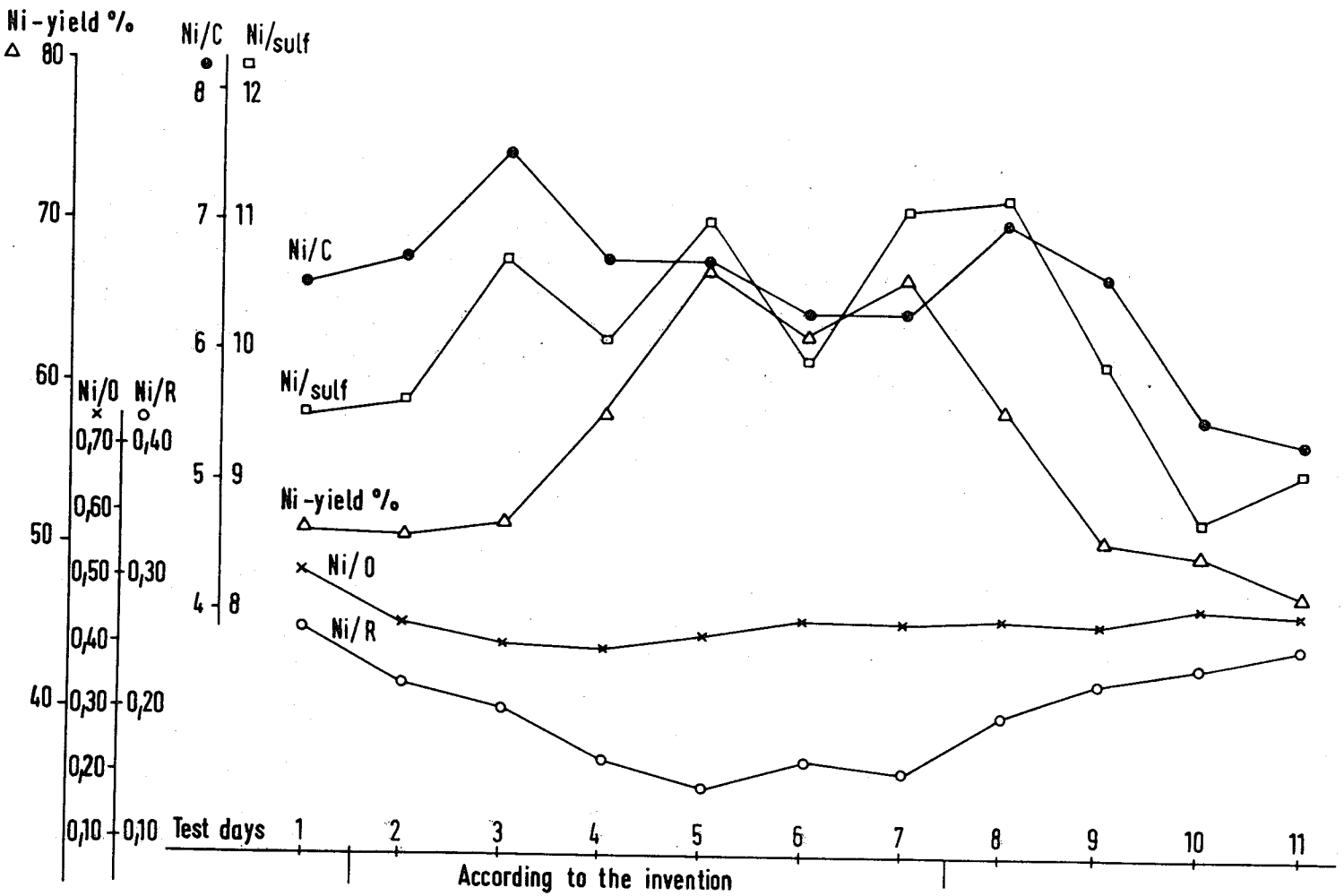
Ni-yield %
Ni/C
Ni/sulf
Ni/O
Ni/R
Test days
According to the invention

PROCESS FOR THE SELECTIVE FROTH-FLOTATION OF SULFIDIC, OXIDIC AND SALT-TYPE MINERALS

This is a continuation of application Ser. No. 049,908, filed June 19, 1979, abandoned.

BACKGROUND OF THE INVENTION

The present invention relates to a process for the selective froth-flotation of sulfidic, oxidic and salt-type minerals, whereby the ore is first wet-ground to the fineness appropriate for flotation, whereafter the obtained slurry is prepared and froth-flotated.

This invention relates in particular to the improvement of the selectivity of the flotation of sulfidic minerals in the froth-flotation process, but the process according to the invention can also be applied with success to the froth-flotation of non-sulfidic minerals such as scheelite, ilmenite, apatite and magnesite.

It is known that sulfide minerals can be froth-flotated with high selectivity by using, for example, xanthate as the collector agent; the requirement of xanthate is usually in the order of 50–500 g/t. Selectivity can be improved by using, for example, waterglass as the depressing agent for the silicates.

However, considerable difficulties are encountered in the above known process in the treatment of many sulfidic ores, especially nickel ores.

The characteristics of such problematic ores include a very high specific surface area, which can be up to 10–100 fold the specific surface area of a "healthy" ore ground to the corresponding fineness. This is usually due to the high degree of metamorphism of the ore. As a consequence of metaphorism, the particle size of the sulfide phase is often very small, and therefore the ore must be very finely ground to obtain a sufficient degree of purity of the particles. As a consequence of metamorphism the gangue, i.e. the silicate material, is also often changed. Serpentine, chlorite and talcum are very common metamorphic products in ores of this type, and owing to their softness, easy slurrying and natural hydrophobic property they tend to cause problems.

The high specific area, easy slurrying, natural hydrophobic character and flocculability of the problematic minerals, as well as the small particle size of the sulfide minerals, are the actual causes of problems. These result in, for example, and abnormally high requirement of the collector agent, about 10-fold the normal consumption mentioned previously.

The requirement of other chemicals, for example the $H_2SO_4$ used for pH control, is also very high. In spite of the high quantities of chemicals and the high cost, the results of froth-flotation remain poorer than when using normal ore. This naturally results in a lower profitability. In many cases it is positively uneconomical to exploit ore of the said type by conventional methods.

SUMMARY OF THE INVENTION

It has now been surprisingly observed that the above difficulties can for a large part be eliminated by using in addition to the collector agent a polysaccharide, lignosulfonate, guar gum and/or a surface active additional chemical which prevents the collector agent from adhering to the silicate surfaces and makes them hydrophilic, or weakens the hydrophobia of minerals to which the collector agent has already adhered. Optionally the collector agent and the additional chemical are added already at the wet-grinding stage.

DESCRIPTION OF THE DRAWING

The FIGURE shows, as functions of time, the nickel concentrations in the nickel yield (Ni-yield) and sulfide phase (Ni-sulf), the concentrate (Ni/C), ore (Ni/O) and the residue (Ni/R) when using the process according to the invention (days 2–7) and a known conventional process (days 1 and 8–11).

DESCRIPTION OF THE PREFERRED EMBODIMENTS

The invention is described below in more detail with the aid of examples.

EXAMPLE 1

The first example of the results obtained by this process are the laboratory-scale results obtained using the ore from a nickel mine.

| | Ore | Concentrate | Residue |
|---|---|---|---|
| Experiment 1 | | | |
| % by weight | 100 | 13.6 | 86.4 |
| Ni % | 0.61 | 3.0 | 0.23 |
| Ni Yield % | 100.0 | 67.3 | 32.7 |
| Experiment 2 | | | |
| % by weight | 100.0 | 22.2 | 77.8 |
| Ni % | 0.62 | 2.5 | 0.10 |
| Ni Yield % | 100.0 | 87.6 | 12.4 |

The following reagents were used in Experiment 1, which was performed by a prior known conventional process:

| | |
|---|---|
| $H_2SO_4$ (preparation and froth-flotation, pH = 4) | 24 kg/t |
| K—amyl xanthate (added to the preparation) | 2 kg/t |
| "Turpenso", frothing agent (added to the preparation) | 300 g/t |

"Turpenso" is produced by Oy Enso-Gutzeit Ab, Finland, and it has the following average composition: monoterpenes 35–55%, terpene alcohols 10–20%, and sesquiterpenes 25–50%.

The following additional chemicals were used in Experiment 2:

| | |
|---|---|
| Polyglycol ether (added to the preparation) | 400 g/t |
| Alkylphenolethylene oxide (added to the preparation) | 400 g/t. |

In Experiment 2 the yield of nickel was 20 percentage points better owing to the chemicals added according to the present invention. In both of the experiments mentioned above the degree of grinding was the same, ~70%–74 μm, and the experimental conditions were similar in other respects as well.

EXAMPLE 2

The second example of the applicability of the present process consists of the results obtained using a lower-grade intermediate pulp ore of a nickel mine.

| | Ore | Concentrate | Residue |
|---|---|---|---|
| Experiment 3 | | | |
| % by weight | 100 | 9.9 | 90.1 |
| Ni % | 0.40 | 2.5 | 0.17 |

-continued

| | Ore | Concentrate | Residue |
|---|---|---|---|
| Ni yield % | 100 | 61.4 | 38.6 |
| Experiment 4 | | | |
| % by weight | 100 | 19.7 | |
| Ni % | 0.41 | 1.9 | 0.08 |
| Ni yield % | 100.0 | 85.2 | 14.8 |

Experiment 3 represents the results obtained by a conventional process, and the following reagents were used in it:

| | |
|---|---|
| $H_2SO_4$ (preparation + froth-flotation; pH = 4) | 29 kg/t |
| K—amyl xanthate (added to the preparation) | 2 kg/t |
| "Turpenso", frothing agent (added to the preparation) | 300 g/t |
| Degree of grinding ~70% − 74 μm. | |

The results of Experiment 4 were obtained using the process according to this invention, and the following reagents were used in it in addition to the reagents of Experiment 3:

| | |
|---|---|
| Polyglycol ether (added to the preparation) | 400 g/t |
| Dinonylphenolethylene oxide (added to the preparation) | 400 g/t |

By comparing these experimental results with each other, it can be observed that in Experiment 4 the Ni yield was, owing to the additional chemicals, approx. 24 percentage points better than in Experiment 3.

The increases in the yield indicated by Examples 1 and 2 mean a net product of approx. 8–15 Fmk per one tonne of ore, which is of considerable economic importance in the exploitation of ore of such a low grade (average concentration ~0.5% Ni).

EXAMPLE 3

The third example of the advantages of the present invention is the increase in the Ni yield obtained using a problematic-type fraction of another nickel ore, shown in the following table. Both experiments of the example, i.e. Experiments 5 and 6, were performed under similar conditions except that the additional chemicals mentioned below were used in Example 6.

| | Ore | Concentrate | Residue |
|---|---|---|---|
| Experiment 5 | | | |
| % by weight | 100.0 | 10.6 | 89.4 |
| Ni % | 0.73 | 4.3 | 0.31 |
| Ni Yield % | 100.0 | 63.7 | 36.3 |
| Experiment 6 | | | |
| % by weight | 100.0 | 16.9 | 83.1 |
| Ni % | 0.74 | 3.6 | 0.16 |

-continued

| | Ore | Concentrate | Residue |
|---|---|---|---|
| Ni yield % | 100.0 | 81.2 | 18.8 |

The following conventional reagents were used in Experiment 5:

| | |
|---|---|
| $H_2SO_4$ (preparation and froth-flotation; pH = 4.5) | 12 kg/t |
| K—amyl xanthate (added to the preparation) | 300 g/t |
| "Turpenso", frothing agent (added to the preparation) | 450 g/t |

In accordance with the present invention, the following additional reagents were used in Experiment 6:

| | |
|---|---|
| Polyglycol ether (added to the preparation) | 60 g/t |
| Nonylamine-ethylene oxide (added to the preparation) | 100 g/t |

Owing to the additional chemicals, the Ni yield increased 17.5 percentage points, which means a net product of approx. 14 Fmk per one tonne of ore, using an ore of this grade.

The above examples very clearly show that the factors mentioned in the ingress, which worsen the concentration results, can be eliminated by a very simple method, i.e. by using suitable additional chemicals. In the example experiments described above the additional chemicals were added to the preparation, but it is more advisable to add them as early as the grinding stage, where the surfaces of the mineral particles are still "fresh" and the selectivity of the froth-flotation is thereby easier to maintain.

EXAMPLE 4

The fourth example, in which the process according to the present invention was trial run on the industrial scale, shows that on the industrial scale it is possible to achieve an increase in the yield similar to that given above obtained on the laboratory scale, which is the actual proof of the applicability of the present invention. The accompanying FIGURE is a graphical representation of the results of an industrial scale trial run. The FIGURE shows, as functions of time, the nickel concentrations in the nickel yield (Ni-yield) and sulfide phase (Ni/sulf), the concentrate (Ni/C), ore (Ni/O) and the residue (Ni/R) when using the process according to the invention (days 2–7) and a known conventional process (days 1 and 8–11), there being a gradual shift from the known process to the process according to the invention and back. The points represent averages over 24 hours. The additives used and the degree of grinding are shown in the table below:

TABLE

| | Day | | | | | | | | | | |
|---|---|---|---|---|---|---|---|---|---|---|---|
| Additive g/t | 1 | 2 | 3 | 4 | 5 | 6 | 7 | 8 | 9 | 10 | 11 |
| Nonylamine-ethylene oxide | | | 42 | 80 | 8 | 12 | 8 | | | | |
| Dinonylphenol-ethylene oxide | | 180 | 56 | 320 | 310 | 380 | 250 | | | | |
| Polyglycol ether | | 7 | 18 | 8 | 19 | 34 | 18 | | | | |
| Neutral oil | | 63 | 172 | 90 | 234 | 434 | 242 | | | | |
| "Turpenso" | 470 | 310 | 470 | 250 | 530 | 1090 | 620 | 630 | 640 | 820 | 820 |
| Isobutyl xanthate | 1830 | 1810 | 1870 | 1680 | 1800 | 1690 | 1590 | 1450 | 2060 | 2180 | 2130 |
| Degree of grinding % − 74 μm | 55 | 59 | 50 | 50 | 63 | 42 | 47 | 54 | 59 | 64 | 54. |

It can be observed from the FIGURE that during the trial run the nickel concentration in the sulfide phase was more than 10% (average 10.4%). This shows that the ore involved is very difficult to concentrate by conventional processes. This was also the case regarding the ore specimens used as test materials in the first two examples; nickel concentration in the sulfide phase was >10%. Before the trial run the yield was in the order of 50%. During the trial run there was a gradual shift to the process according to the present invention. Thereby the results improved continuously. The process according to the invention was in use for three days, the yield being then 66% (average). It fell from this to the order of 47% when the operation shifted to the conventional process.

One advantage of the process according to the present invention is that the chemicals which improve the selectivity can be added as such to the process (to the grinding, preparation, etc., stage), and, for example, no expensive emulsifying equipment is required.

Another essential factor in the treatment of the problematic sulfide ores of the type described above is the density of the slurry, i.e. the solids content of the slurry passing to the froth-flotation, given in percentages by weight of the slurry, must be considerably lower (20–25%) than when treating a corresponding ore with a healthy gangue (solids 30–40%). The reason is that the gangue materials which cause the said problems, i.e. serpentine, chlorite, talcum, etc., easily cause the ore slurry to flocculate and thicken. This means an increase in the viscosity of the slurry, i.e., a poorer flow of the slurry. This, for its part, results in that the mixing of the frothing chemicals with the ore slurry becomes more complicated, i.e., the preparation time is lengthened. Likewise, the dispersion of the frothing air into the slurry becomes more difficult at the froth-flotation stage and is usually nearly impossible when using conventional processes, unless the density of the slurry is decreased. The additional chemicals according to the present invention have an improving effect on the flow properties of the slurry, and so the density of the slurry need not be decreased as much as in conventional processes. At a slurry density of 25–30% the froth-flotation operates well. This means savings since the requirement of water to be circulated in the process is lower.

Both on the laboratory scale and on the industrial scale, the addition to the grinding stage of chemicals improving the selectivity, mentioned in the third example, has been observed to improve the result over a case in which the said chemicals are added to the preparation stage. In treating sulfide ores it has, furthermore, been observed that in cases where the froth-flotation is carried out in an acid milieu, the addition of the collector agent (xanthate, thiophosphate, etc.) already to the grinding or preparation stage, which is performed in an alkali or neutral milieu, whereafter the slurry is made acid, yields better results than adding the collector agent to preparation in an acid milieu. In the industrial-scale trial run of the fourth example, the said chemicals (also the collector agent) were first added to an acid preparation. The results were considerably improved when a shift was made to the process according to the present invention and the said chemicals were added to the alkali grinding, whereafter the slurry was made acid.

The chemicals used for improving the selectivity in the above examples were reagents of the polyglycol ether-alkyl-phenolethylene oxide and alkylamine-ethylene oxide types. A similar effect is obtained when using, instead of the said reagents, ethoxylated carboxylic acids, ethoxylated fatty alcohols, carboxymethyl cellulose or its derivatives, dextrine, starch, guar gum, lignosulfonate or some other surface-active agent which eliminates the "collector-agent consuming" property of the silicate surfaces, making them hydrophilic, or weakens the hydrophobic character of the non-desirable minerals, in which case they are not froth-flotated to the degree they would be without the said additional chemicals, and thereby a considerably more distinct separation between the desirable and non-desirable minerals is obtained.

EXAMPLE 5

The fifth example consists of the use of the additional chemicals, according to the invention, in the froth-flotation of non-sulfidic minerals. It is known that magnesite can be froth-flotated, obtaining a good yield, by using a fatty-acid type collector agent when the gangue material is, for example silicate, but when the ore also contains other carbonates dolomite calcine), the froth-flotating properties of which are very similar to those of magnesite, the grade of the magnesite concentrate obtained is not sufficiently high when conventional processes are used. In this example it is dolomite which causes problems since it tends to froth-flotate together with magnesite, thereby increasing the CaO concentration in the magnesite concentrate; in a high-grade magnesite concentrate this concentration should be <1%. The following results were obtained by the process according to the present invention.

Concentrations in the feed and the magnesite concentrate. the latter corresponds to a magnesite yield of 60%.

| | MgO % | CaO % | $Co_2$ % | $SiO_2$ % | Fe % | Al % |
|---|---|---|---|---|---|---|
| Feed | 38.0 | 2.8 | 42.0 | 13.1 | 1.9 | 1.4 |
| Magnesite concentrate | 46.5 | 0.7 | 49.4 | 0.49 | 1.5 | <0.1 |

The above results correspond to an approximate purity of 94% of the magnesite concentrate. The CaO concentration is <1%. The $SiO_2$, Fe and Al concentrations caused by the silicates are very low.

The above results were obtained by using the following chemicals for the froth-flotation:

| | |
|---|---|
| Erucic acid free rape fatty acid (EFRFA) (manufacturer Raision Tehtaat, Raisio) | 250 g/t |
| "Berol 26" (alkylarylpolyglycol ether, manufacturer Berol, Kemi) | 125 g/t |
| "Acrol J2P" (modified quarqum manufacturer Trochem Ltd.) | 1000 g/t |
| $NH_4HF_2$ | 1800 g/t. |

Of these chemicals Berol 26 and Acrol J2P belong to the chemicals which improve selectivity according to the present invention, and without them the result is considerably poorer. Especially the CaO concentration derived from dolomite is considerably higher, 1.5–2%, which results in that such a concentrate is not usable as a raw material for fireproof materials, i.e. the concentrate is not marketable.

Fully analogously to Example 5, additional chemicals of this type can be used for improving the selectivity in the froth-flotation of scheelite or ilmenite as well, when it is performed using a fatty-acid type or similar anionic collector agent, especially if the ore contains carbonates or other minerals which are froth-flotated with the same collector-agent type.

The composition of the collector agent used also has a significant effect on the selectivity of the froth-flotation of non-sulfidic minerals. The fatty-acid collector agent (EFRFA) used in Example 5 has the following composition:

| | EFRFA | Fatty acid 1 | Fatty acid 2 |
|---|---|---|---|
| Oleic acid | 60% | 45% | 22% |
| Linolenic acid | 19% | 34% | 64% |
| Linoleic acid | 10% | 2% | 1% |
| Others = | 11% | 19% | 8% |
| saturated shorter- or longer-chain fatty acids. | | | |

In the above table there are two other fatty acids which have also been tested on the ores of the above example experiments under the same conditions as EFRFA. The results obtained with fatty acid 1 were similar to those obtained with EFRFA. With fatty acid 2 the selectivity was considerably lower than with EFRFA and fatty acid 1. This shows that the polyansaturated components linoleic and linolenic acid) of the fatty acid must be in the correct proportion to the amount of oleic acid for the collector agent to be suitable for the concentration of the ore described in Example 5. Pure oleic acid yields results nearly similar to those obtained with EFRFA and fatty acid 1, bu it is unnecessarily expensive for this purpose.

It is known that the collector effect of collector agents of various types (xanthate, thiophosphate, fatty acid, amine, etc.) i.e. the force with which they attach to an air bubble, increases with an increased hydrocarbon chain length, when comparing representatives of the same collector-type with hydrocarbon chains of different lengths. Furthermore, it has been observed regarding collector agents of the fatty-acid type that in collector agents representing the same hydrocarbon chain length the collector effect is further enhanced by the unsaturation of the hydrocarbon chain, i.e., the number of double bonds.

The most common fatty acids used in concentration technique are within the range $C_{10}$–$C_{22}$, the best known being:

| Name | Chemical formula | Number of double bonds in the hydrocarbon chain |
|---|---|---|
| Myristic acid | $C_{14}H_{28}O_2$ | 0 |
| Palmitic acid | $C_{16}H_{32}O_2$ | 0 |
| Stearic acid | $C_{18}H_{36}O_2$ | 0 |
| Oleic acid | $C_{18}H_{34}O_2$ | 1 |
| Linoleic acid | $C_{18}H_{32}O_2$ | 2 |
| Linolenic acid | $C_{18}H_{30}O_2$ | 3 |
| Behenic acid | $C_{22}H_{44}O_2$ | 0 |

-continued

| Name | Chemical formula | Number of double bonds in the hydrocarbon chain |
|---|---|---|
| Erucic acid | $C_{22}H_{42}O_2$ | 1 |

The collector effect of the fatty acids mentioned in the above list thus increases in the following order: myristic acid<palmitic acid<stearic acid (length of chain increases), further stearic acid<oleic acid<linoleic acid<linolenic acid (length of the chain is the same but the number of double bonds increases) and behenic acid<erucic acid (for the same reason).

The differences between the results obtained in the above comparative tests with three different fatty acids (EFRFA, fatty acid 1 and fatty acid 2) can be explained on the basis of this. In EFRFA and fatty acid 1, the proportion of polyunsaturated components is $<\frac{1}{2}$ of the active part (=oleic acid+linoleic acid+linolenic acid+longer-chain saturated and unsaturated fatty acids), while in fatty acid 2 it is $>\frac{2}{3}$ of the active part. This naturally results in that, if the material to be froth-flotated contains minerals with highly similar froth-flotation properties, then a more effective collector agent is less selective in the separation of the minerals. This is fully analogous to the froth-flotation of sulfidic minerals, when the froth-flotation is performed using, for example, xanthate collector agents having a hydrocarbon chain of a different length.

What is claimed is:

1. A process for the selective froth-flotation of sulfidic minerals from silicate minerals with an anionic collector agent, comprising first wet-grinding the minerals to flotation fineness to obtain a slurry of the minerals; and then conditioning and froth-flotating the slurry in acidic conditions by using as the anionic collector a xanthate or thiophosphate, and comprising using in addition to the anionic collector agent at least one additional chemical selected from the group comprising ethoxylated alklyl phenols, ethoxylated alkyl amines, ethoxylated carboxyclic acids and ethoxylated fatty alcohols, said ethoxylated compounds being longer chained than hexyl ethoxylates, to passivate active silicate mineral surfaces or weaken the hydrophobia of undesirable minerals to which the collector agent has already adhered.

2. A process according to claim 1, comprising adding the additional chemical before or simultaneously with the collector agent.

3. A process according to claim 1, comprising adding the collector agent and the additional chemical in the wet-grinding stage.

4. A process according to claim 1, for the froth-flotation of sulfidic minerals, in which the pH of the mineral slurry is adjusted after the addition of the collector agent.

5. A process according to claim 1 for the froth-flotation of sulfidic minerals, comprising using the additional chemical in a quantity of 10–40% by weight of the quantity of the collector agent used.

* * * * *

UNITED STATES PATENT AND TRADEMARK OFFICE

CERTIFICATE OF CORRECTION

PATENT NO. : 4,368,117

DATED : January 11, 1983

INVENTOR(S) : Vaino V. H. Hintikka

It is certified that error appears in the above—identified patent and that said Letters Patent is hereby corrected as shown below:

Column 6, line 22:

parenthesis and comma omitted, "other carbonates dolomite calcine)," should be --other carbonates (dolomite, calcine),--.

Column 7, line 15:

Under "Fatty acid 2", first percentage "22%" should be --27%--.

Signed and Sealed this

Fifth Day of April 1983

[SEAL]

*Attest:*

GERALD J. MOSSINGHOFF

*Attesting Officer*

*Commissioner of Patents and Trademarks*